US010946429B2

(12) United States Patent
Dong

(10) Patent No.: US 10,946,429 B2
(45) Date of Patent: Mar. 16, 2021

(54) RESTRAINING MEMBER, AND PROCESSING DEVICE AND CONVEYING DEVICE USING THE RESTRAINING MEMBER

(71) Applicant: FLEXI-SCRAM CO., LTD., Nagoya (JP)

(72) Inventor: Yuan Dong, Nagoya (JP)

(73) Assignee: FLEXI-SCRAM CO., LTD., Nagoya (JP)

( * ) Notice: Subject to any disclaimer, the term of this patent is extended or adjusted under 35 U.S.C. 154(b) by 275 days.

(21) Appl. No.: 16/082,477

(22) PCT Filed: Feb. 14, 2017

(86) PCT No.: PCT/JP2017/005363
§ 371 (c)(1),
(2) Date: Sep. 5, 2018

(87) PCT Pub. No.: WO2017/169211
PCT Pub. Date: Oct. 5, 2017

(65) Prior Publication Data

US 2019/0099795 A1 Apr. 4, 2019

(30) Foreign Application Priority Data

Mar. 29, 2016 (JP) ..... JP2016-066852

(51) Int. Cl.
*B21D 22/22* (2006.01)
*B21D 37/20* (2006.01)
(Continued)

(52) U.S. Cl.
CPC ..... *B21D 22/22* (2013.01); *B21D 24/04* (2013.01); *B21D 28/343* (2013.01); *B21D 37/20* (2013.01); *B21D 22/208* (2013.01); *B21D 37/16* (2013.01)

(58) Field of Classification Search
CPC .... Y10T 428/24355; Y10T 428/24479; B21D 22/22; B21D 24/02; B21D 25/04; B21D 28/343; B21D 37/20; B32B 3/30
(Continued)

(56) References Cited

U.S. PATENT DOCUMENTS

2014/0147629 A1* 5/2014 Tanaka ..... B29C 45/37 428/141

FOREIGN PATENT DOCUMENTS

DE 198 05 706 A1 8/1999
JP S63-034521 U 3/1988
(Continued)

OTHER PUBLICATIONS

Mar. 14, 2017 Search Report issued in International Patent Application No. PCT/JP2017/005363.

*Primary Examiner* — Debra M Sullivan
(74) *Attorney, Agent, or Firm* — Oliff PLC

(57) ABSTRACT

A restraining material includes a frictional surface configured to press against an object to restrain the object and exert a frictional force thereon. The frictional surface is a pattern surface of a base material of the restraining member that will directly contact with the object. The pattern surface includes island-shaped parts separated by a depression and periodically arranged. The depression has a depth of 15 to 50 μm with respect to the frictional surface. A periodic arrangement direction of the island-shaped parts includes a direction defined by that: a pattern index determined by dividing an arrangement pitch of the island-shaped parts in a periodic arrangement direction by the maximum diameter of each island-shaped part in the periodic arrangement direction falls within a range of 1.0 to 100, and the maximum diameter of each island-shaped part in the periodic arrangement direction falls within in a range of 0.1 to 2 mm.

7 Claims, 11 Drawing Sheets

(51) Int. Cl.

| | |
|---|---|
| ***B21D 24/04*** | (2006.01) |
| ***B21D 28/34*** | (2006.01) |
| *B21D 22/20* | (2006.01) |
| *B21D 37/16* | (2006.01) |

(58) Field of Classification Search
USPC ..... 451/285–288
See application file for complete search history.

(56) References Cited

FOREIGN PATENT DOCUMENTS

| | | | |
|---|---|---|---|
| JP | H04-070212 | U | 6/1992 |
| JP | H07-051757 | A | 2/1995 |
| JP | 2002-336915 | A | 11/2002 |
| JP | 2004-009107 | A | 1/2004 |
| JP | 2014-213344 | A | 11/2014 |

* cited by examiner

RESTRAINING MEMBER, AND PROCESSING DEVICE AND CONVEYING DEVICE USING THE RESTRAINING MEMBER

CROSS-REFERENCE TO RELATED APPLICATIONS

This is a US national phase application based on the PCT International Patent Application No. PCT/JP2017/005363 filed on Feb. 14, 2017, and claiming the priority of Japanese Patent Application No. 2016-066852 filed on Mar. 29, 2016, the entire contents of which are herewith incorporated by reference.

TECHNICAL FIELD

The present invention relates to a restraining member for restraining an object to be processed or an object to be conveyed and also exert a frictional force on the object. This relates to for example a fixing pad to be used when a thin sheet metal member is to be subjected to pressing process, the fixing pad being operated to press a portion of the targeted thin sheet metal member other than a portion to be processed to fix the thin sheet metal member, and a conveying roll which is operated to rotate in contact with a strip-shaped thin sheet metal member to convey this thin sheet metal member. Furthermore, the present invention also relates to a processing device and a conveying device each utilizing the foregoing restraining member.

BACKGROUND ART

In various fields for processing/working and conveying, conventionally, the foregoing restraining member has been already used. One example in the field of a press forming device is disclosed as a "presser-foot member 14" in Patent Document 1 directed to a "pressing process method and a forming apparatus" (see [0018], claim 9, and FIGS. 3 and 5 in Patent Document 1). According to the technique in this document, the "presser-foot member 14" presses a peripheral edge of a portion of a "workpiece 11" to be processed against a "die 13" to hold the "workpiece 11". In this state, the "workpiece 11" is press-worked by a "punch 15" and the "die 13".

RELATED ART DOCUMENTS

Patent Documents

Patent Document 1: JP 2014-213344 A

SUMMARY OF INVENTION

Problems to be Solved by the Invention

However, the foregoing conventional technique has the following problems. One of the problems is that the frictional performance of the restraining member such as the "presser-foot member 14" in the above-described document gradually decreases through the use of the apparatus. As the apparatus is repeatedly used, accordingly, such a decreased frictional performance of the "presser-foot member 14" causes lowering of the processing accuracy for a workpiece. Furthermore, the apparatus could no longer continue to perform the processing/working and thus needs replacement of the "presser-foot member 14" with a new one. Similarly, the conveying roll and others in the conveying device also have a problem with the frictional performance that gradually decreases. Therefore, the conveying device has to be designed with a restraining member having properties estimated somewhat lower. This leads to a complicated structure of the apparatus.

The present invention has been made to solve the above problems found in the conventional technique. Specifically, the purpose of the invention is to provide a restraining member with superior frictional performance and, particularly, with high friction coefficient and frictional property controlled to meet the intended use. Another purpose is to provide a restraining member that is less likely to decrease in frictional performance with use. Still another purpose is to provide a processing device and a conveying device, respectively enhanced in workability and conveying performance by use of the restraining member.

Means of Solving the Problems

To achieve the above purpose, one aspect of the invention provides a restraining member including a frictional surface configured to press against an object to restrain the object and exert a frictional force on the object, wherein the frictional surface is formed as a pattern surface that is a surface of a base material of the restraining member that will directly contact with the object, the pattern surface including island-shaped parts separated by a depression and periodically arranged within the surface, the depression has a depth in a range of 15 to 50 μm with respect to the frictional surface, and a periodic arrangement direction of the island-shaped parts of the pattern surface includes a direction defined by a condition that: a pattern index falls within a range of 1.0 to 100, the pattern index being determined by dividing an arrangement pitch of the island-shaped parts in the periodic arrangement direction by a maximum diameter of the island-shaped parts in the periodic arrangement direction, and the maximum diameter of the island-shaped parts in the periodic arrangement direction falls within a range of 0.1 to 2 mm.

The restraining member in the above aspect will contact with the object through the frictional surface corresponding to the pattern surface including the island-shaped parts arranged in a special periodic pattern. Since the frictional surface is the pattern surface, the frictional state between the frictional surface and an object differs from the frictional state generated by a general flat surface and thus the frictional property differs depending on the pattern index. Accordingly, just by selecting the pattern index to meet the intended use, a restraining member can be provided with a frictional property most suitable for the intended use. When the pattern index is set to 3.1 or more, for instance, a restraining member can be configured suitable for the intended use directed to a hard material and with an acting-force index (representing (F/Y) as described later) of about 2.0 and that does not allow sliding. For an acting-force index of 3.0 or more, when the pattern index is set to 2.0 or more, a restraining member can be configured suitable for the intended use that is directed to a hard material and does not allow sliding. When the pattern index is set to 1.8 or more, a restraining member can be configured suitable for the intended use that is directed to a soft material with an acting-force index of about 1.4 and does not allow sliding. When the pattern index is set within a range of 1.2 to 3.0, a restraining member can be configured suitable for the intended use that is directed to a hard material with an acting-force index of about 2.0 and allows sliding. When the pattern index is set within a range of 1.0 to 1.7, a restraining member can be configured suitable for the intended use that is directed to a soft material with an acting-force index of about 1.4 and allows sliding.

Another aspect of the invention provides a processing device configured to perform processing on a flat plate-shaped workpiece by use of a punch, wherein the processing using the punch is a punching process to punch out a portion of the workpiece to form a hole, the processing device includes a restraining member configured to restrain a portion of the workpiece other than the portion to be subjected to the punching process using the punch, the restraining member is as described above, in which the frictional surface corresponds to a surface that will contact with the workpiece during the punching process using the punch, the restraining member is disposed so that a radial direction centered on the portion of the workpiece to be subjected to the punching process using the punch coincides with the periodic arrangement direction, and the pattern index falls within a range of 1.8 to 100.

Another aspect of the invention provides a conveying device configured to convey a flat plate-shaped object to be conveyed by rotation of a roll, wherein the roll is the aforementioned restraining member, in which the frictional surface is a cylindrical surface that will contact with the object during conveyance, a circumferential direction of the frictional surface coincides with the periodic arrangement direction, and the pattern index falls within a range of 1.8 to 100.

In the restraining member according to the present aspect, more preferably, the condition of the periodic arrangement direction is satisfied in two or more directions. Furthermore, it is preferable that the pattern index in the first periodic arrangement direction falls within a range of 3.1 to 100 and the pattern index in a second periodic arrangement direction falls within a range of 1.2 to 3.0. Alternatively, it may be arranged such that the pattern index in a first periodic arrangement direction falls within a range of 1.8 to 100, and the pattern index in a second periodic arrangement direction falls within a range of 1.0 to 1.7.

Another aspect of the invention provides a processing device configured to perform processing on a flat plate-shaped workpiece by use of a punch, wherein the processing using the punch is a drawing process to deform a portion of the workpiece, the processing device includes a restraining member configured to restrain a portion of the workpiece other than the portion to be subjected to the drawing process using the punch, the restraining member satisfies the condition of the periodic arrangement direction in the two or more directions, in which the frictional surface is a surface that will contact with the workpiece during the drawing process using the punch, and the restraining member is disposed so that: a radial direction centered on the portion of the workpiece to be subjected to the drawing process using the punch coincides with the second periodic arrangement direction; and a circumferential direction around the portion of the workpiece to be subjected to the drawing process using the punch coincides with the first periodic arrangement direction.

Effects of the Invention

The present configuration provides the restraining member with superior frictional performance and, particularly, with high friction coefficient and frictional property controlled to meet the intended use. Furthermore, the restraining member is provided with the frictional performance that is less likely to decrease with use. In addition, the present configuration also provides a processing device and a conveying device respectively enhanced in workability and conveying performance by use of the restraining member.

MODE FOR CARRYING OUT THE INVENTION

Figure 1:
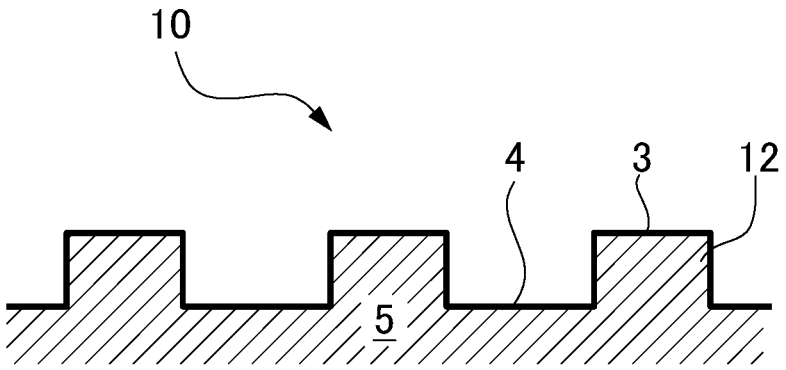
FIG. 1 is a sectional view of a restraining member in an embodiment.

A detailed description of a preferred embodiment of the present invention will now be given referring to the accompanying drawings. A restraining member 10 in the present embodiment is provided with a surface basically having asperities (protrusions and depressions) as shown in a sectional view of FIG. 1. The surfaces of the protrusions 12 are frictional surfaces 3, which are separated in island shape by a depression 4. These protrusions 12 are portions left after the depression 4 is formed in the surface of a base material 5 of the restraining member 10. The protrusions 12 are not formed of deposition materials deposited on the base material 5. Thus, when the frictional surfaces 3 corresponding to the surfaces of the protrusions 12 are placed in contact with an object, it means that the base material 5 itself of the restraining member 10 directly contacts with the object. The protrusions 12 are periodically arranged.

Figure 2:
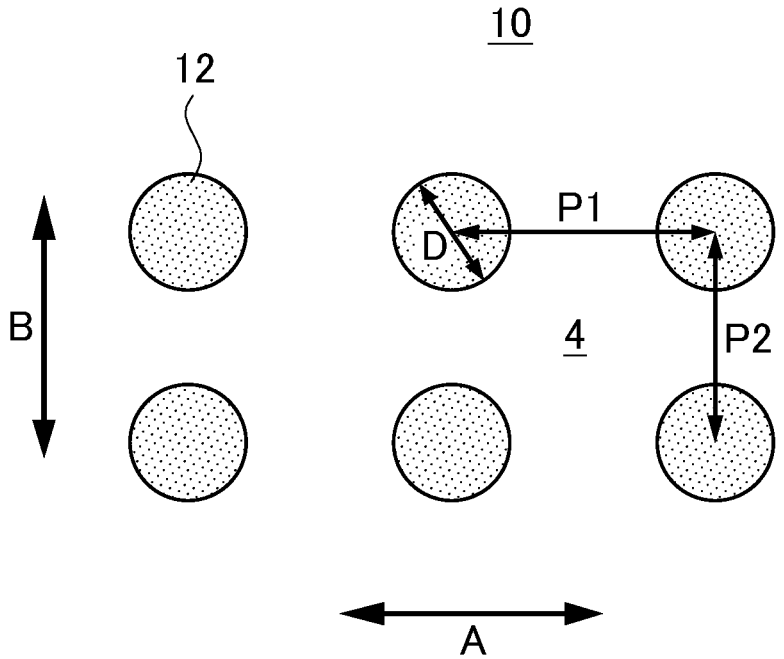
FIG. 2 is a plan view of the restraining member in the embodiment.

The protrusions 12 in the restraining member 10 in the present embodiment are arranged as shown in a plan view of FIG. 2. In the present embodiment, specifically, each of the protrusions 12 is circular when seen from above. In the plan view of FIG. 2, the protrusions 12 are periodically arranged in two directions, that is, a direction A and a direction B. These directions A and B are perpendicular to each other. In the pattern shown in FIG. 2, from the viewpoint of intervals between the protrusions 12, the direction B is a first proximity direction which is the narrowest interval. The direction A is a second proximity direction which is the second narrowest interval. A diagonal direction in a rectangle defined by four protrusions 12 is a third proximity direction which is the third narrowest interval.

The depth of the depression 4 is preferably determined in a range of 15 to 50 μm. A too-shallow depression is not preferable it leads to an insufficient restraining force on a workpiece. On the other hand, a too-deep depression is not preferable because it leads to an insufficient strength against deformation of the shape of each protrusion 12. The diameter D of each protrusion 12 is preferably within a range of 0.1 to 2 mm. A too-small diameter is also unpreferable because it leads to an insufficient strength against deformation of the shape of each protrusion 12. On the other hand, a too-large diameter is also unpreferable because it leads to an insufficient restraining force on a workpiece. Furthermore, the smoothness of the frictional surfaces 3 is not particularly limited and has only to make the frictional surface 3 visible to the naked eyes as a planar or flat surface. The material of the restraining member 10 is not particularly limited as long as it is a metal material and others corresponding to a hard material which will be mentioned later. For example, the material of the restraining member 10 may be selected from carbon steel, stainless steel and other special steel, or alternatively those steels having undergone various surface treatments such as plating. Even if the restraining member 10 is subjected to a surface treatment such as plating, this configuration does not run counter to the meaning that the "base material of the restraining member directly contacts with the object".

Figure 3:
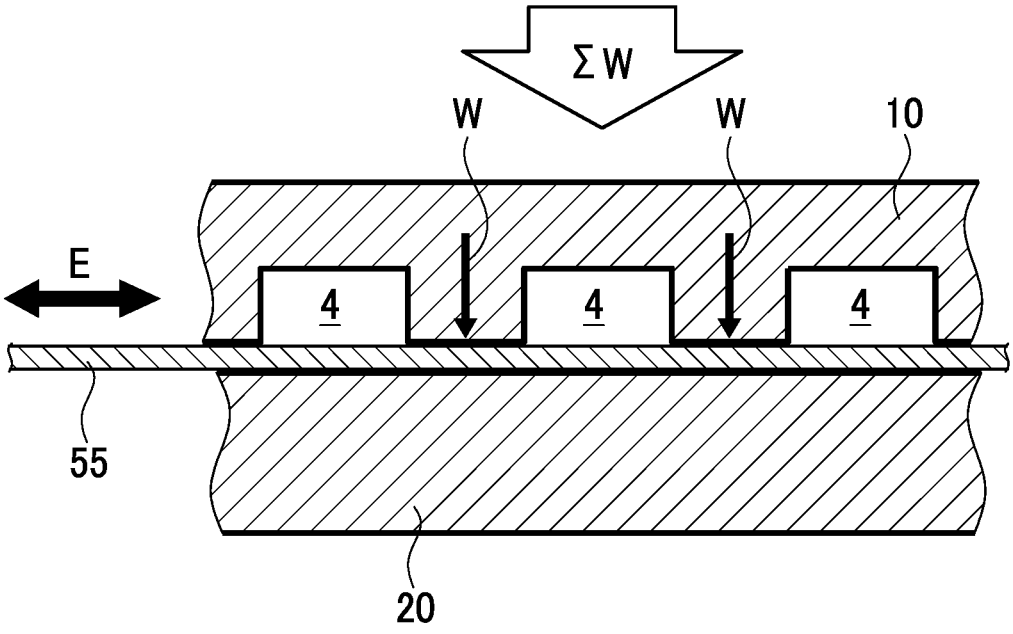
FIG. 3 is a sectional view (No. 1) showing a state of contact regions of the restraining member and a workpiece in the embodiment.
Figure 4:
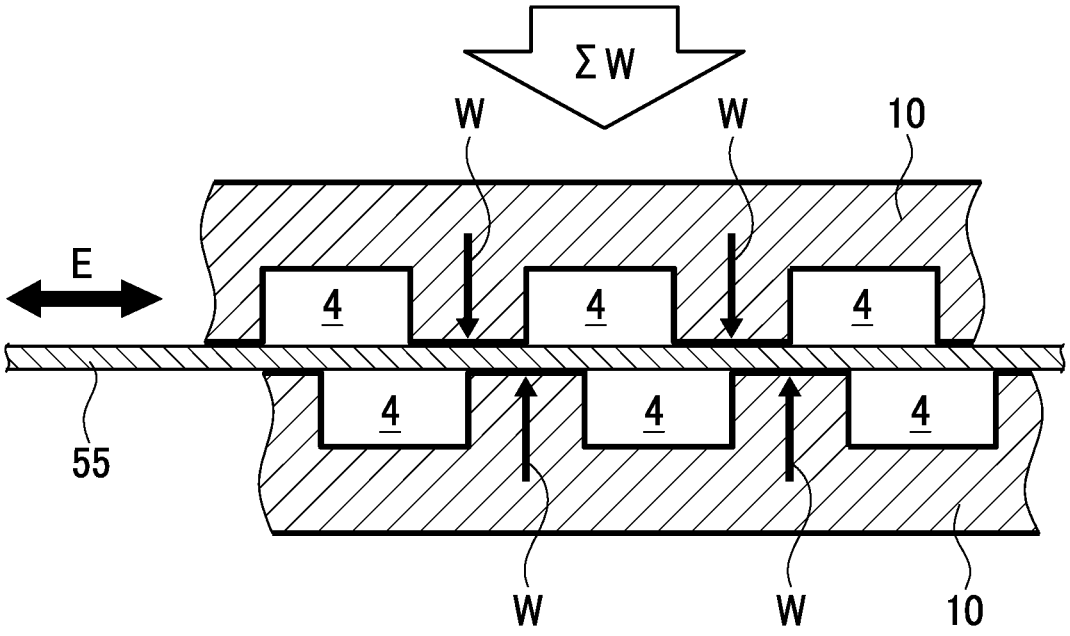
FIG. 4 is a sectional view (No. 2) showing a state of contact regions of the restraining member and a workpiece in the embodiment.

FIGS. 3 and 4 show contact states of the restraining member 10 and a workpiece plate 55 in the present embodiment shown in FIGS. 1 and 2. Specifically, FIG. 3 shows a state where the workpiece plate 55 is held between the restraining member 10 of the present embodiment and a restraining member 20 having a general planar surface. FIG. 4 shows a state where the workpiece plate 55 is held from above and below between the restraining members 10 of the present embodiment. In each side of the workpiece plate 55 contacting with the restraining member 10 (an upper side in FIG. 3 and upper and lower sides in FIG. 4), the depression 4 is applied with no load and each protrusion 12 is applied with a load W. The sum of loads W on the protrusions 12 is a total load W. A frictional force due to this load W restricts sliding of the workpiece plate 55 (in a direction E) with respect to the restraining member 10. In this state where the workpiece plate 55 is restricted from sliding, the workpiece plate 55 is subjected to processing.

Figure 5:
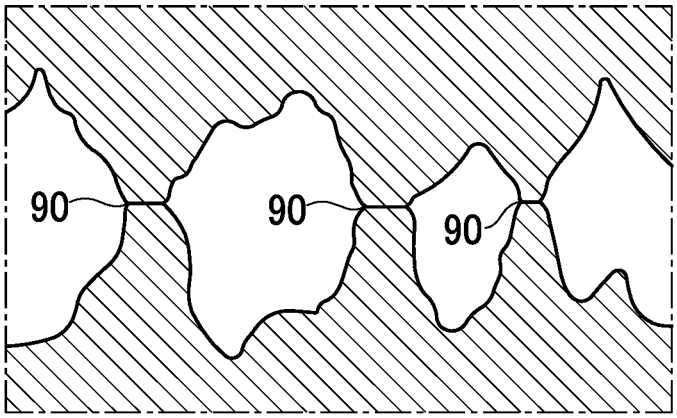
FIG. 5 is an enlarged sectional view of a contact state of flat surfaces.

Herein, a generally explained free surface friction model will be briefly described below. According to a general friction model, even in the contact between surfaces considered to be planar, many contact points 90 between microscopic protrusions as shown in a sectional view of FIG. 5 are discretely present in an actual situation. The distribution of those contact points 90 and a concrete contact state at each contact point 90 are completely uncontrolled and thus unknown. The generation state of stress due to contact at each contact point 90 has been merely discussed as Hertzian contact stress in a model of protrusions each having an idealized shape. In such a discussion, the frictional force of a free surface is expressed by the sum of an adhesion term due to adhesion between the materials at each contact point 90 and a digging term due to digging of a softer material by a leading end of a protrusion of a hard material caused from sliding between materials.

Figure 6:
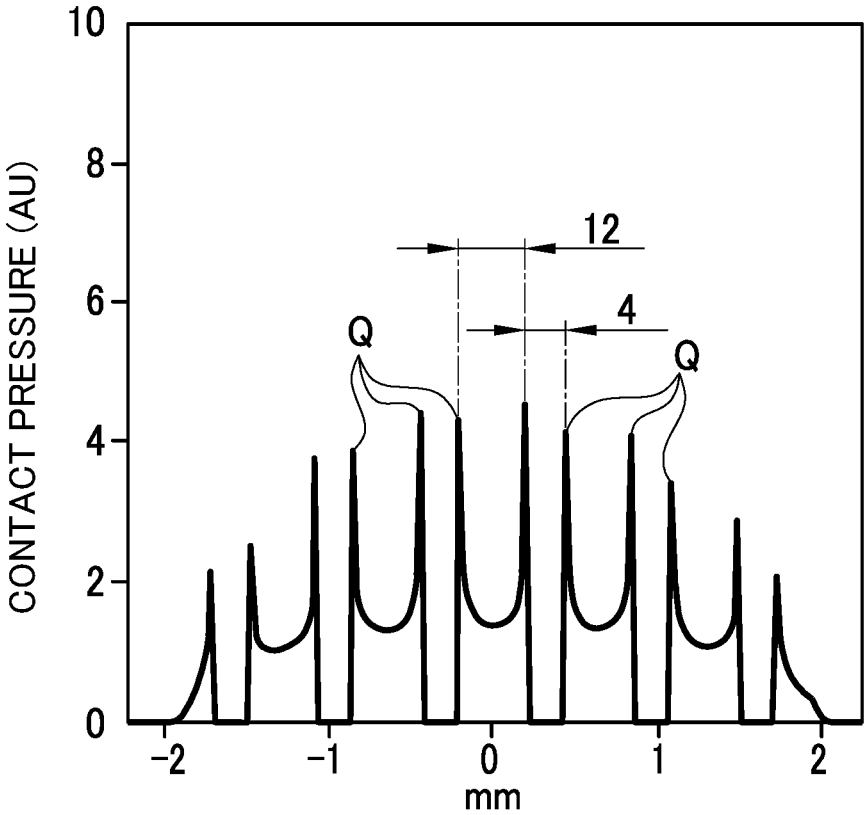
FIG. 6 is a graph showing a distribution of pressure in the restraining member (high-density pattern) in contact with a workpiece in the embodiment.

On the other hand, in the restraining member 10 in FIGS. 1 and 2, contact with an actual object to be processed or conveyed (hereinafter, simply referred to as a workpiece) is concentrated on an edge portion of the surface of each protrusion 12 (the frictional surface 3). Specifically, the distribution of contact pressure in the frictional surface 3 appears in the form shown in a graph of FIG. 6. The graph of FIG. 6 shows a distribution of contact pressure in the restraining member 10 on a line passing through the center of each protrusion 12 and extending in parallel to the direction A (alternatively the direction B).

In this graph, the contact pressure at each area corresponding to the depression 4 is naturally zero. At an area corresponding to each protrusion 12 (the frictional surface 3), finite values of pressure are present but the distribution of the pressure is not uniform. In other words, the pressure value is relatively low near the center of each protrusion 12 and high near an edge of each protrusion 12. The pressure value exhibits a peak Q at each edge. The pressure value at each peak Q is naturally higher than the contact pressure in the case of a simple planar surface such as the foregoing Hertzian model. The occurrence of such a pressure distribution is a unique phenomenon caused by the restraining member 10 having an asperity pattern shape shown in FIGS. 1 and 2.

Figure 7:
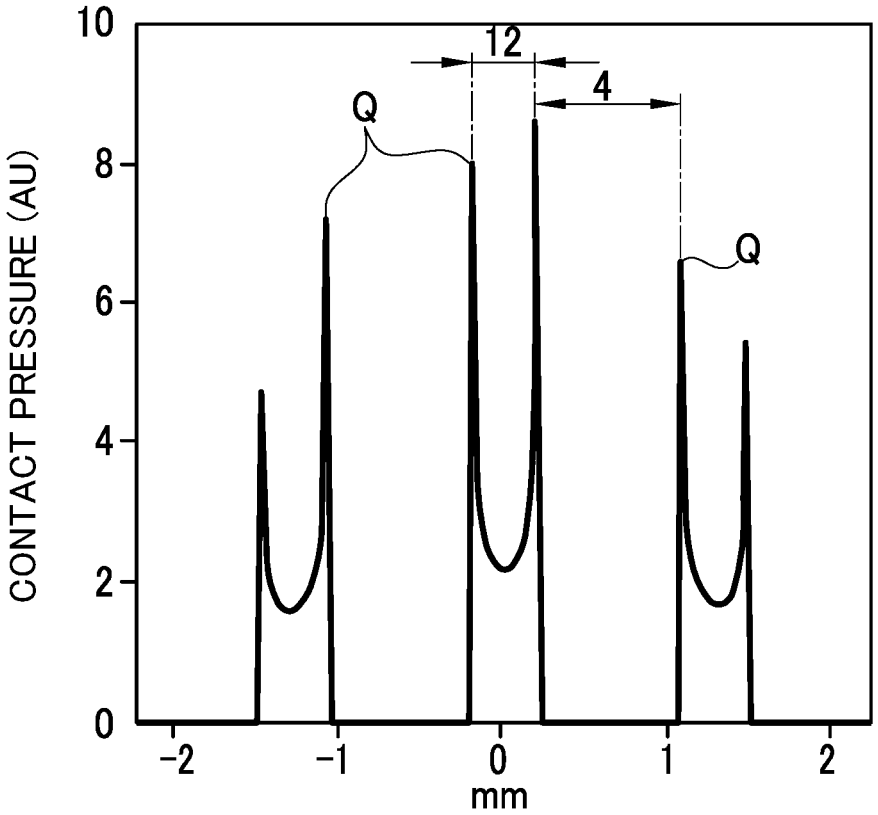
FIG. 7 is a graph showing a distribution of pressure in the restraining member (low-density pattern) in contact with a workpiece in the embodiment.

Accordingly, the restraining member 10 exhibits the specific frictional property different from the frictional property of a general material. Specifically, the frictional property can be controlled by the arrangement of the protrusions 12. This is because the height of each peak Q depends on the arrangement pitch of the protrusions 12 in the sliding direction (the distance between the centers of protrusions 12 located adjacently in the sliding direction). For example, FIG. 7 is a graph similar to that in FIG. 6 but the arrangement pitches of the protrusions 12 are different therefrom. The arrangement pitch shown in the graph of FIG. 7 is larger than that in FIG. 6. Specifically, the distribution density of the protrusions 12 is high in the arrangement pattern in FIG. 6 and low in the arrangement pattern in FIG. 7. Thus, the height of each peak Q is higher in FIG. 7 than in FIG. 6. In FIGS. 6 and 7, the scale of the vertical axis and the scale of the horizontal scale are equal between their graphs.

Herein, the "sliding direction" represents an acting direction of the force on a workpiece to cause the workpiece to slip with respect to the restraining member 10. In general, a processing machine is configured such that the sliding direction is defined by the first proximity direction (Direction B), the second proximity direction (Direction A), or the third proximity direction (Oblique direction) in a lattice-shaped arrangement pattern of the protrusions 12 as shown in FIG. 2.

Accordingly, the restraining member 10 provides three types of frictional properties according to the distribution densities of the protrusions 12. This is explained below referring to graphs of FIGS. 8 and 9. In the graphs of FIGS.

Figure 8:
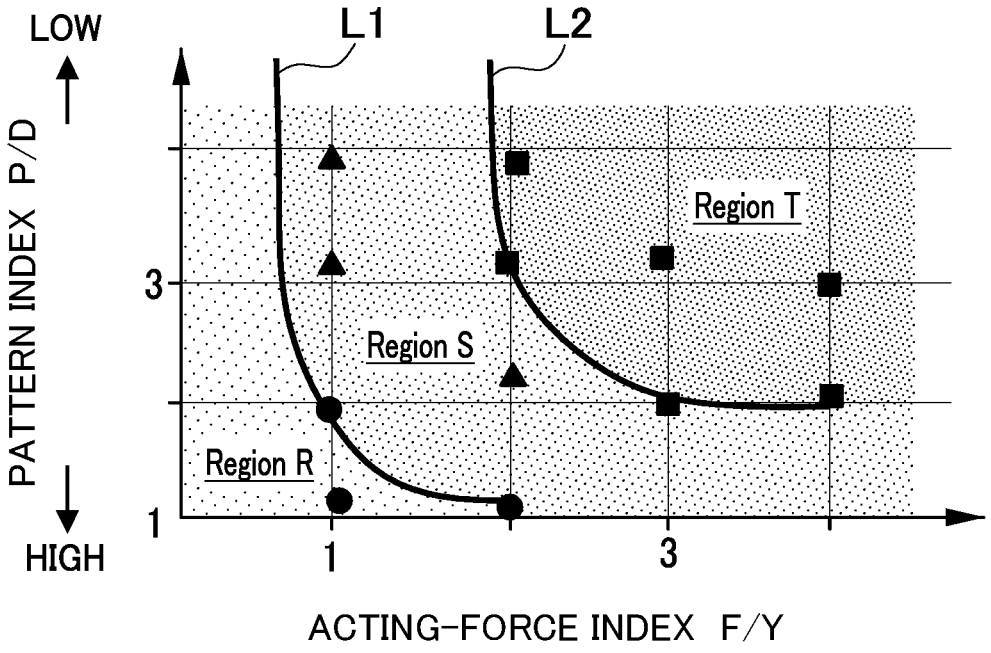
FIG. 8 is a graph (No. 1) showing a relationship between arrangement pitch in the restraining member and pressing force on a workpiece in the embodiment.
Figure 9:
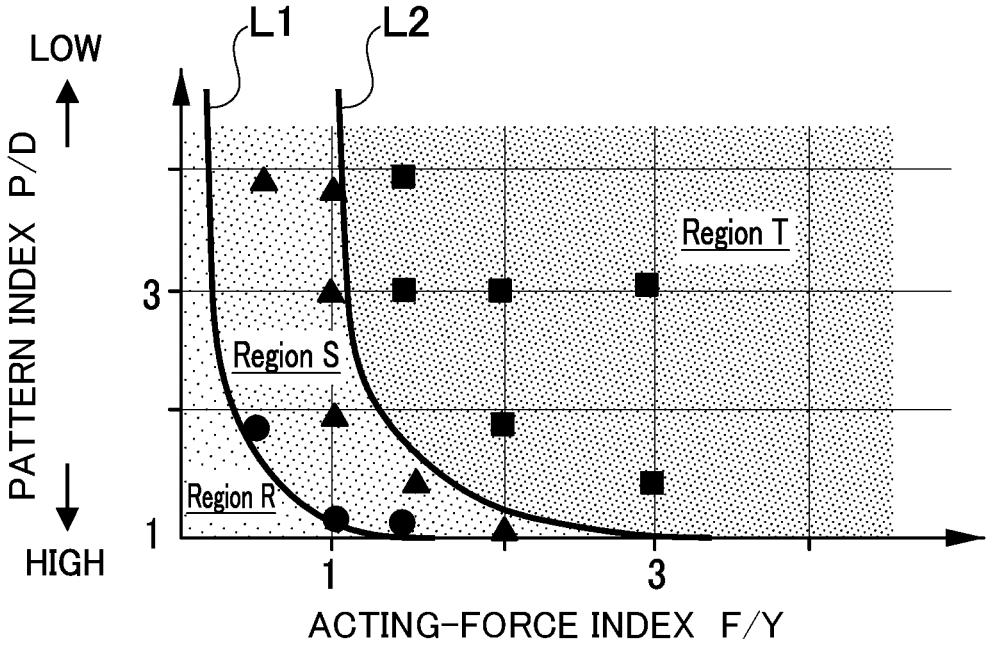
FIG. 9 is a graph (No. 2) showing a relationship between arrangement pitch in the restraining member and pressing force on a workpiece in the embodiment.

8 and 9, the vertical axis corresponds to the distribution density of the protrusions 12 in the sliding direction and the horizontal axis corresponds to the pressing force on a workpiece. Specifically, FIG. 8 is a graph for a workpiece that is a hard material (a tensile strength TS of 590 MPa or higher), such as a thin steel plate. FIG. 9 is a graph for a workpiece that is a soft material (a tensile strength TS of less than 590 MPa), such as an aluminum thin plate.

To be concrete, the vertical axis in each graph of FIGS. 8 and 9 defines (P/D) where D denotes the diameter of each protrusion 12 (to be exact, a maximum diameter in the sliding direction) and P denotes the arrangement pitch of the protrusions 12 in the sliding direction. Herein, this (P/D) is called a "pattern index". For the asperity pattern shape shown in FIG. 2, the diameter D of each protrusion 12 is constant irrespective of the sliding directions. The arrangement pitch P is defined as P1 when the sliding direction is the direction A in FIG. 2 and as P2 when the sliding direction is the direction B. In the vertical axis in FIGS. 8 and 9, the distribution density of the protrusions 12 is lower toward an upper side and higher toward a lower side. The horizontal axis in each graph of FIGS. 8 and 9 defines (F/Y) where F denotes the pressing force per macroscopic area of the surface of each protrusion 12 (the frictional surface 3) and Y denotes the yield stress of a workpiece. Herein, this (F/Y) is called an "acting-force index".

In each graph of FIGS. 8 and 9, the first quadrant in the foregoing vertical axis and horizontal axis is partitioned into three regions by two nearly-hyperbolic curves L1 and L2. Each of these curves L1 and L2 curves downward from left to right and more gently slopes down to the right. Over the entire range, the curve L2 is above (to the right of) the curve L1. Comparing FIGS. 8 and 9, both the curves L1 and L2 are overall lower (to the left) in FIG. 9 than in FIG. 8.

A region R below the curve L1 (on the side close to the vertical axis and the horizontal axis) is a region that a workpiece stays in an elastic range without reaching a plastic range. This is because in the region R the distribution density of the protrusions 12 is high and the peak Q of pressure values is low (FIG. 6) as displayed in FIGS. 6 and 7. In this region R, therefore, a small friction coefficient is provided between the restraining member 10 and the workpiece. Thus, the region R is suitable for the intended use for which generation of the frictional force between the restraining member 10 and the workpiece is not demanded so much.

A region S defined between the curves L1 and L2 is a region that a workpiece reaches from the elastic range to the plastic range. This is because in the region S the distribution density of the protrusions 12 is lower and the peak Q of pressure values is somewhat higher than in the region R. In this region S, therefore, a relatively large friction coefficient is provided between the restraining member 10 and the workpiece. Thus, the region S is suitable for the intended use for which generation of a large braking force is desirable while sliding between the restraining member 10 and the workpiece is allowed to a certain extent.

A region T above the curve L2 is a region that a workpiece locally completely enters in the plastic region. This is because in the region T the distribution density of the protrusions 12 is further lower and the peak Q of pressure values is considerably higher (FIG. 7) than in the region S. In this region T, therefore, the restraining member 10 can fully restrain the workpiece. Thus, the region T is suitable for the intended use for which the workpiece is desired to be placed perfectly in a fixed state with respect to the restraining member 10.

Actually, in either case shown in FIGS. 8 and 9, a friction test is conducted by variously setting at least one of the pattern index and the acting-force index to different values in order to determine the index range available in a region suitable for the target intended use, selected from among the regions R, S, and T. Thus, the restraining member 10 is used under the conditions within the determined range. For instance, it is supposed that the material of the restraining member 10 and the material of the workpiece have already been specified. It is further supposed that the acting-force index in use also has been specified. In this case, several restraining members 10 are produced with different pattern indexes and subjected to the friction test, so that the range of the pattern index available in the target region can be determined. In contrast, while using a prescribed value as the pattern index, the range of the acting-force index may be determined in the friction test. Therefore, it is not necessarily required to exactly determine the entire shape of the foregoing curves L1 and L2.

Some intended uses for which the restraining member 10 of the present embodiment is suitably used will be exemplified as below.

Figure 10:
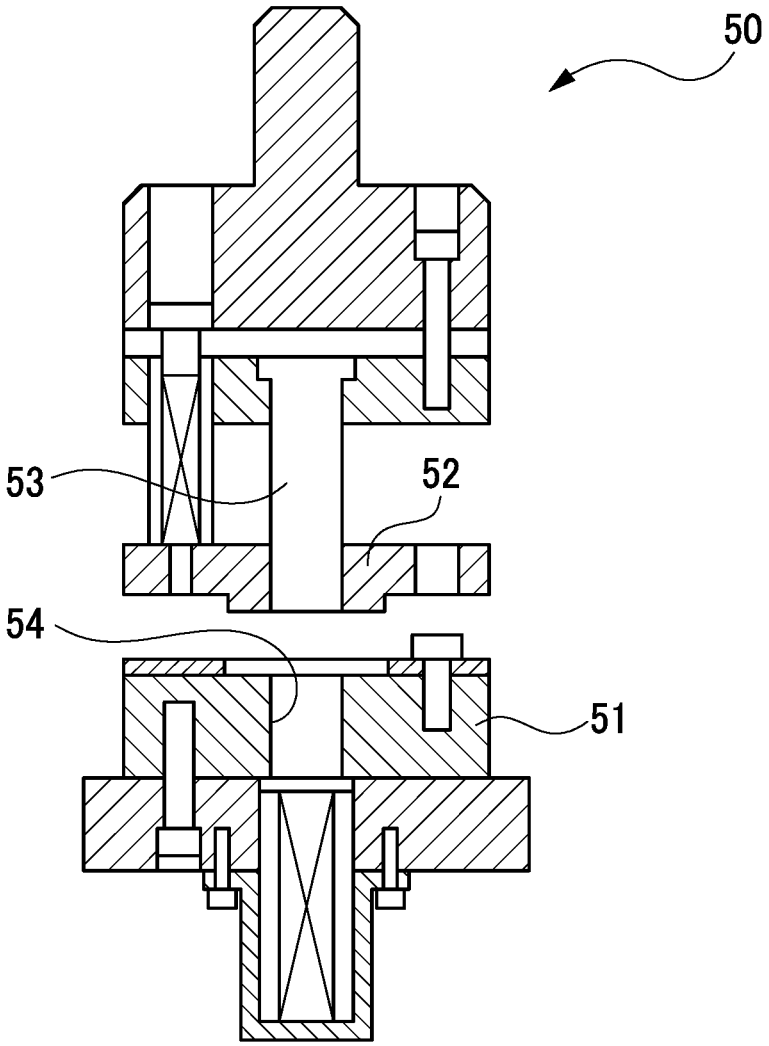
FIG. 10 is a sectional view of a main part of a pressing machine which is a usage example of the restraining member in the embodiment.

FIG. 10 is a schematic sectional view of a pressing machine 50 which is one example of such intended devices. The pressing machine 50 in FIG. 10 includes a die 51, a stripper 52, and a punch 53. The die 51 is formed with a hole portion 54. The pressing machine 50 is configured to process a workpiece by pressing a flat plate-shaped workpiece with the stripper 52 to fix it on the die 51 and then pushing a portion of the workpiece into the hole portion 54 with the punch 53.

The pressing machine 50 can perform a hole-making process by punching. When the punching process is to be carried out with the pressing machine 50, a workpiece plate is put on the die 51 and then pressed against the die 51 with the stripper 52. The stripper 52 serves to press down the workpiece plate at a position not overlapping the hole portion 54 when seen from above. Accordingly, the workpiece plate is retained in a fixed state on the die 51 with the stripper 52.

Figure 11:
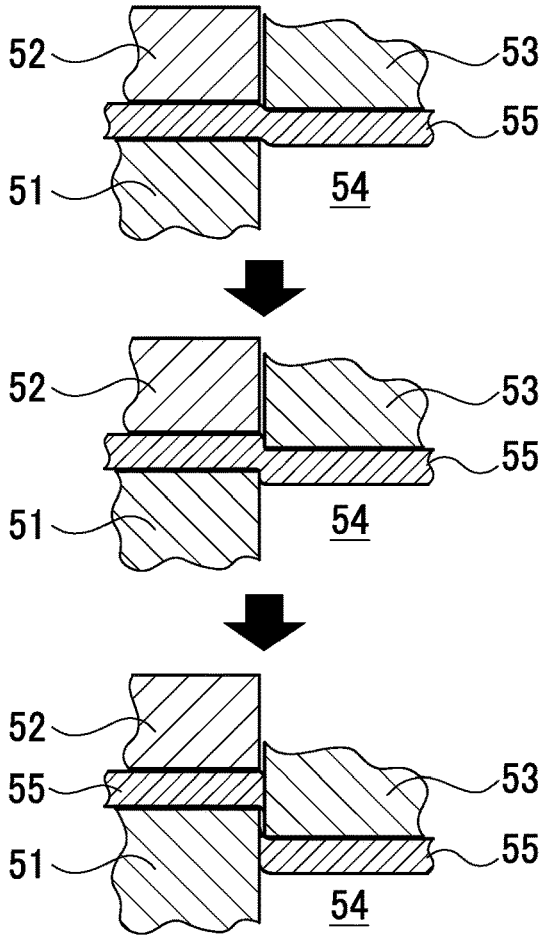
FIG. 11 is a sectional view showing an execution state of a punching process using the pressing machine.

In this state, as shown in an uppermost view in FIG. 11, the punch 53 is moved downward. The punch 53 is configured to be moved up and down at a position overlapping the hole portion 54 when seen from above. Thus, a portion of the workpiece plate 55 located above the hole portion 54 is about to move downward. In contrast, another portion of the workpiece plate 55 located on the die 51 is fixed with the stripper 52 and thus remains unmoved. Therefore, the portion of the workpiece plate 55 located above the hole portion 54 is moved into the hole portion 54 so as to separate from the portion located on the die 51, as shown in a middle view and further a lowermost view in FIG. 11. In this manner, the portion the workpiece plate 55 above the hole portion 54 is punched out, forming a hole.

Of the foregoing components of the pressing machine 50, the die 51 and the stripper 52 are suitably applied with the restraining member 10 of the present embodiment. The restraining member 10 is ideally applied to both the die 51 and the stripper 52 but may be applied to only either one. In the die 51 and the stripper 52, the surfaces to be placed in contact with the workpiece plate 55 held in the fixed state are designed as the pattern surface shown in FIG. 2 and other figures. In the pressing machine 50, accordingly, the die 51 and the stripper 52 provide a high friction coefficient with respect to the workpiece plate 55 and thus the punching process can be well carried out.

In such a punching process, it is preferable to use the pattern surfaces of the die 51 and the stripper 52 under the condition corresponding to the region T in the graph of FIG. 8 or 9. This is because the punching process is desired to be carried out while the workpiece plate 55 is fully fixed with the die 51 and the stripper 52. In the punching process, particularly, the entire workpiece plate 55 is subjected to tension in a direction toward a portion punched with the punch 53 and the hole portion 54. Thus, the pattern surfaces of the die 51 and the stripper 52 are preferably configured to meet the condition of the region T in the foregoing sliding direction defined by the radial direction centered on the punched portion. However, it is not necessary to establish this condition in all directions of 360°. It is sufficient that the pattern surfaces satisfying the condition of the region T are arranged in at least four directions with respect to the punched portion.

Concretely, the coordinate in the horizontal axis of the graph of FIG. 8 or 9 is determined based on the ratio between the pressing force of the stripper 52 on the die 51 in the pressing machine 50 and the yield stress of the workpiece plate 55. In contrast, the ratio determined based on the diameter D and the arrangement pitch P in the pattern surface has only to fall within the region T in the graph. Actually, it may be determined as a result of the friction test as described above.

Figure 12:
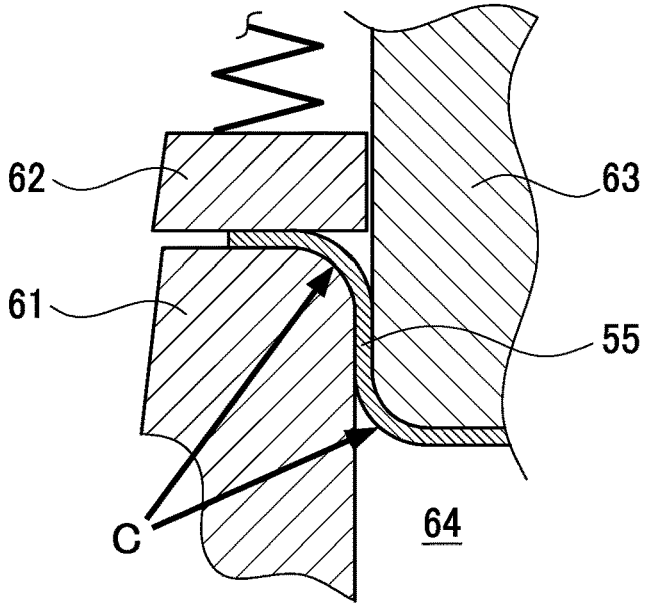
FIG. 12 is a sectional view showing an execution state of a drawing process using a pressing machine.

FIG. 12 discloses another example showing a drawing process using the pressing machine 50. Basic components, such as a die 61, a stripper 62, and a punch 63, are similar to those in the punching process, excepting the following differences. Specifically, the die 61 and the punch 63 each have a rounded shoulder as indicated by arrows C. Furthermore, a clearance nearly equal to the thickness of the workpiece plate 55 is formed between the hole portion 64 of the die 61 and the side surface of the punch 63. In the example shown in FIG. 12, the punch 63 and the hole portion 64 are circular in cross section. Of course, the surfaces of the die 61 and the stripper 62 that will contact with the workpiece plate 55 are designed as the forgoing pattern surfaces as in the punching process.

In the drawing process, the shape of the workpiece plate 55 is originally a flat-plate shape as described above. However, the portion of the workpiece plate 55 located above the hole portion 64 is not cut away from the portion located on the die 61 by the drawing process. The workpiece plate 55 is deformed with both the portions being continuous as shown in FIG. 12. In the drawing process, differently from the punching process, the material forming the portion of the workpiece plate 55 located on the die 61 flows into the hole portion 64 during the process. If the material does not flow, a portion of the workpiece plate 55 is torn off from other portions as in the foregoing punching process. Meanwhile, it is also necessary to prevent the generation of wrinkling of a processed portion.

In the pressing machine 50 for performing the drawing process, therefore, the pattern surfaces of the die 61 and the stripper 62 are desired to provide the frictional properties different between a materiel flowing direction and a perpendicular direction thereto. Specifically, in relation to the material flowing direction, that is, in the radial direction centered on the axis of the punch 63, the pattern surfaces are desired to satisfy the condition corresponding to the region S in the graph of FIG. 8. In contrast, in relation to the direction perpendicular to that direction, that is, in a circumferential direction around the axis of the punch 63, the pattern surfaces are desired to satisfy the condition corresponding to the region T in the graph of FIG. 8. For example, in the lattice-shaped arrangement pattern of the protrusions 12 shown in FIG. 2, the first proximity direction (Direction B) is perpendicular to the second proximity direction (Direction A). Therefore, the arrangement pitches P1 and P2 may be set such that one of the direction A and the direction B satisfies the condition of the region S and the other satisfies the condition of the region T and those directions coincide with the aforementioned directions. Accordingly, it is possible to basically restrict the motion of the workpiece plate 55 with a high friction coefficient to prevent the generation of wrinkling and also cause the material of the workpiece plate 55 to flow in the radial direction as needed. This enables a high-quality drawing process to be performed with stability in product shape. In this case, naturally, the pattern surfaces have only to be arranged so as to meet the foregoing condition in at least four directions with respect to a processed portion.

Figure 13:
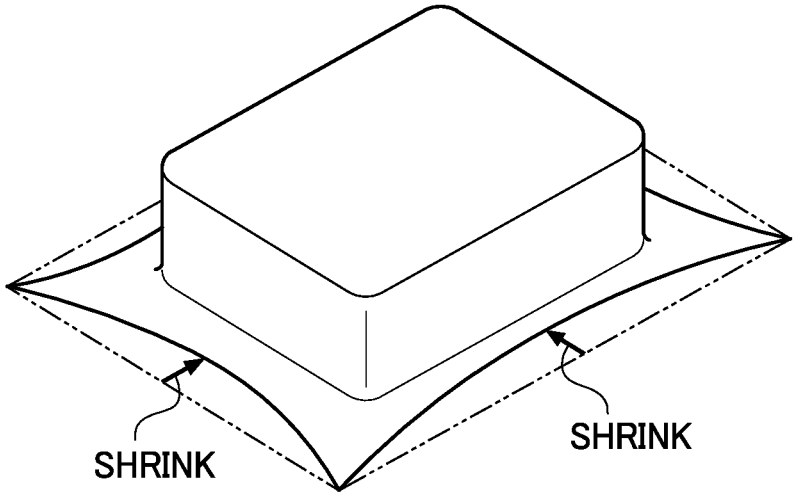
FIG. 13 is a perspective view of one example of a shaped object formed by pressing process.

When a rectangular protrusion as shown in FIG. 13 is formed by press forming, side portions, rather than a top portion, of a flat-shaped part left after processing undergo large shrinkage due to inflow of material. To stably obtain a high-accurate product shape, it is necessary to minimize the inflow of material in the top portion while appropriately controlling this shrinkage. In the case of an irregular shape shown in FIG. 14, a flat bottom portion 56 is likely to undergo surface distortion because disbalance in material flow between flowing directions. For this reason, the press forming is conventionally performed by variously putting draw beads 57 to full use. However, there are still some cases where it is difficult to smoothly form a product in a desired shape. Even when a relatively simple shape as shown in FIG. 13 is to be formed, the draw beads 57 are sometimes used.

Figure 14:
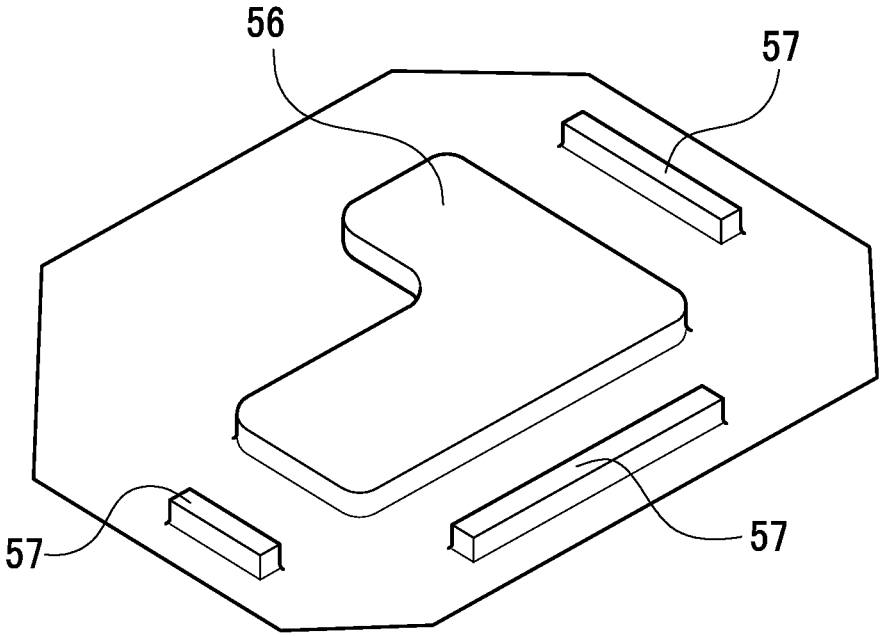
FIG. 14 is a perspective view of another example of a shaped object formed by pressing process.

Even in such a case, however, when the restraining member 10 of the present embodiment is applied to the die 61 or the stripper 62, good forming can be realized. Specifically, a portion of the die 61 and a portion of the stripper 62, located in the positions in which inflow of the material should be suppressed, have to be configured to satisfy the condition of the region T in the graph of FIG. 8 in at least a flowing direction. In contrast, a portion of the die 61 and a portion of the stripper 62, located in the positions in which inflow of the material is allowed to a certain extent, have to be configured to establish the condition of the region S in a flowing direction and meet the condition T in a direction perpendicular to the flowing direction. Accordingly, the pressing machine 50 can be designed to enable stable forming of a product shape with high accuracy as shown in FIGS. 13 and 14 without using the draw beads 57. As another example, the draw beads 57 may also be used.

Figure 15:
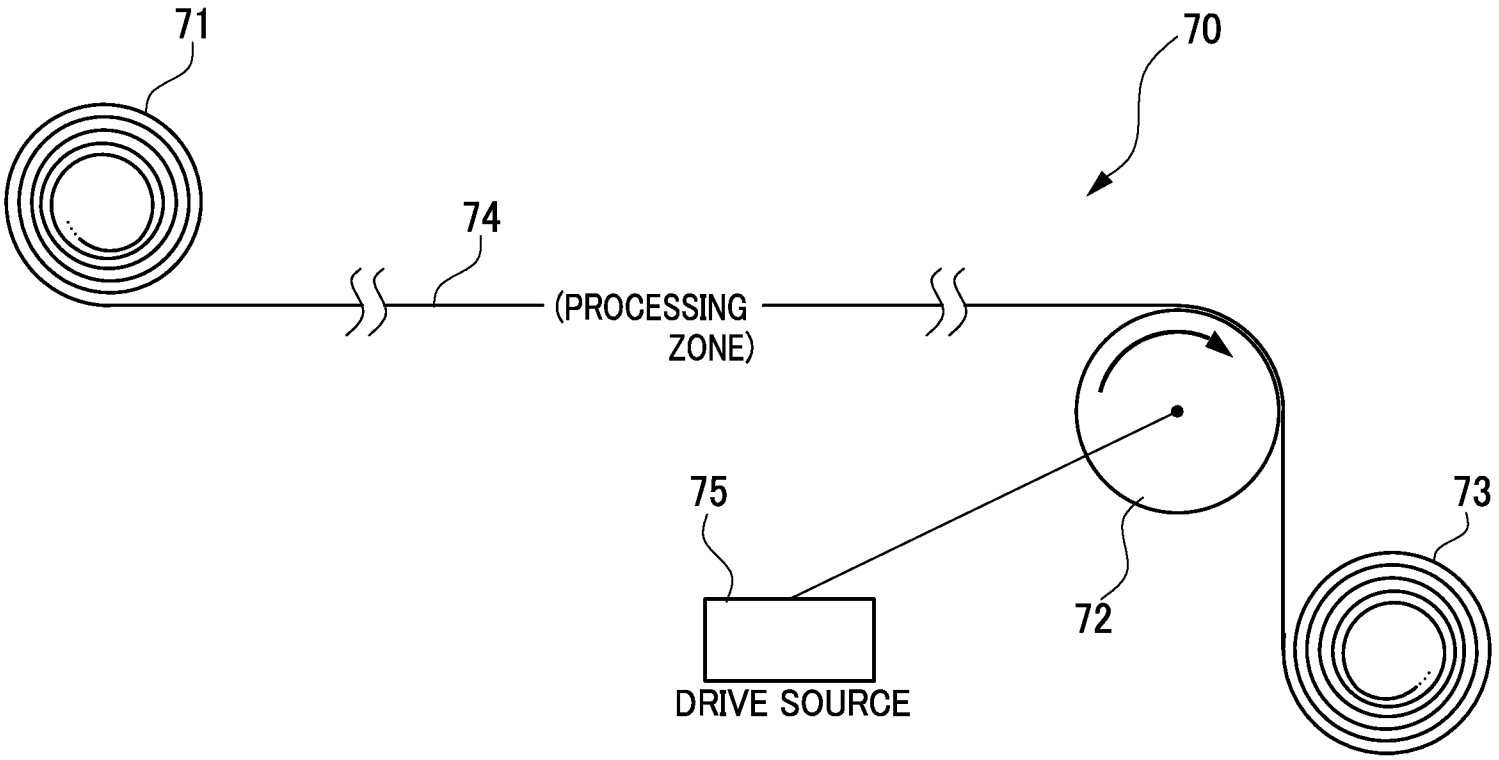
FIG. 15 is a schematic front view of a conveying-processing device for a strip-shaped object.

FIG. 15 schematically shows a conveying-processing device 70 for a strip-shaped object. This is one application example of the restraining member 10 in the present embodiment. The conveying-processing device 70 includes a sheet feeding unit 71, a bridle roll 72, and a sheet winding unit 73. In the conveying-processing device 70, accordingly, a sheet to be conveyed (a conveyed sheet) 74 is fed out from the sheet feeding unit 71 and wound up by the sheet winding unit 73. Herein, the bridle roll 72 is connected to a drive source 75 to cause the conveyed sheet 74 to move in a conveying direction. Further, it is set that the rotational speed of the bridle roll 72 determines the feeding speed of the conveyed sheet 74. Thus, the bridle roll 72 also applies a tensile force on the conveyed sheet 74. Furthermore, a processing zone is provided between the sheet feeding unit 71 and the bridle roll 72, in which the conveyed sheet 74 undergoes some processing (e.g., rolling, surface treatment, heat treatment, and coating).

A typical example of the conveyed sheet 74 is a thin steel plate. However, not limited thereto, the conveyed sheet 74 may also be selected from aluminum or different types of metal foils, non-ferrous metal thin plates, resin sheets, resin films, and others. In the following description, the conveyed sheet 74 is a thin steel plate unless otherwise designated.

In the conveying-processing device 70 in FIG. 15, the bridle roll 72 is a target applied with the restraining member 10 of the present embodiment. Specifically, a cylindrical surface of the bridle roll 72 is configured as the pattern surface shown in FIG. 2 and others. The bridle roll 72 in the conveying-processing device 70 is preferably used under the condition corresponding to the region T in the graph of FIG. 8 in at least the conveying direction of the conveyed sheet 74, that is, in the circumferential direction of the bridle roll 72. This is to reliably restrain the conveyed sheet 74 with respect to the bridle roll 72 in order to well move the conveyed sheet 74 without slipping. Furthermore, it may be used under the condition corresponding to the region T also in the direction perpendicular to the conveying direction, that is, an axial direction of the bridle roll 72. This configuration can also prevent slippage of the conveyed sheet 74 in the width direction (i.e., the axial direction of the bridle roll 72).

Herein, the relationship between the diameter D and the arrangement pitch P (P1 or P2) in the arrangement pattern in FIG. 2 and the frictional properties of the restraining member 10 will be described in more detail. As is clear from the description with reference to the graph of FIG. 8, the frictional properties of the restraining member 10 are greatly influenced by two parameters; the pattern index (P/D) and the acting-force index (F/Y). The acting-force index (F/Y) is substantially determined by the kinds of a portion applied with the restraining member 10 and an object to be processed, i.e., a workpiece, (or an object to be conveyed).

In an example where a workpiece in the foregoing punching process (FIG. 11) or the drawing process (FIGS. 12 to 14) is a hard material (with a tensile strength TS of 590 MPa or higher), the acting-force index (F/Y) needs to be 2.0 or more and preferably 3.0 or more. For a (F/Y) value of about 2.0, the pattern is designed with a (P/D) value of 3.1 or more from FIG. 8, so that the completely fixing condition of the region T can be established. For a (F/Y) value of 3.0 or more, the pattern is designed with a (P/D) value of 2.0 or more, so that a completely fixed condition of the region T can be established. However, the (P/D) value preferably does not exceed 100, even though its upper limit is not limited based on FIG. 8. The (P/D) value more preferably does not exceed 30 and still more preferably does not exceed 10. If the (P/D) value is too large, when the restraining member 10 may warp or bend under a load, causing the depression 4 to contact with the surface of an object. This state does not almost differ from the state of the restraining member 10 having a flat surface. The same applies to a case where a hard material is used as the object to be conveyed in the conveying-processing device 70 of FIG. 15.

When the pattern is designed with the (P/D) value falling within a range of 1.0 to 2.0 (when the (F/Y) value is 3.0 or more), the condition of the region S that permits sliding to a certain extent even with high friction can be established. When the (F/Y) value is about 2.0, the (P/D) value is set within a range of 1.2 to 3.0, so that the condition of the region S can be established. For the drawing process, it is essential only that the condition of the region T be satisfied in a first direction and the condition of the region S be satisfied in a second direction.

On the other hand, when a soft material (with a tensile strength TS of less than 590 MPa) such as an aluminum thin plate is used as a workpiece in the punching process or the drawing process, the (F/Y) value is roughly about 1.4 (about 1.3 to about 1.5). In this case, therefore, the pattern is designed with a (P/D) value of 1.8 or more from FIG. 9, so that the completely fixing condition of the region T can be established. It is however preferable that the (P/D) value does not exceed the foregoing upper limit. The same applies to a case where a soft material is used as the object to be conveyed in the conveying-processing device 70. The pattern is designed with a (P/D) value falling within a range of 1.0 to 1.7, the condition of the region S can be established. For the drawing process, it is essential only that the condition T be satisfied in the first direction and the condition of the region S be satisfied in the second direction. From the above configuration, when the (P/D) value falls within a range of 1.0 to 100, the restraining member 10 can be used for at least one of the hard material and the soft material under the condition of the region T or the region S.

According to the present embodiment as described above in detail, as the frictional surface 3 of the restraining member 10, the protrusions 12 made from the base material 5 itself are arranged in a periodic array pattern and other portions than the protrusions 12 are formed as the depression 4. This configuration is to cause the contact pressure of the restraining member 10 placed in contact with an object to be processed or conveyed to concentrate in an edge portion of each protrusion 12 as disclosed in the graphs of FIGS. 6 and 7. Accordingly, differently from a general friction model, the restraining member 10 configured with the pattern index (P/D) selected in consideration of the acting-force index (F/Y) on an object according to the intended uses can exhibit frictional properties demanded in a portion applied with the restraining member 10. Furthermore, the pressing machine 50 and the conveying-processing device 70 are configured to exert high friction coefficients to an object by placing the restraining member 10 in contact with the object and thus can effectively restrain the object to conduct good processing or conveying of the object.

Moreover, when the restraining member 10 of the present embodiment is used under the condition of the region T particularly in the graph of FIG. 8, this restraining member 10 will be used in a state where slipping hardly occurs between the object and the restraining member 10. Even when the restraining member 10 is used under the condition of the region S, the slipping is not completely eliminated but remains minimal. From this, the dies 51 and 61, the strippers 52 and 62, and the bridle roll 72, to which the restraining member 10 of the present embodiment is applied, are significantly less abraded even after durable use and therefore they have a long service life. Accordingly, this can significantly reduce the troubles of maintenance of the devices, as compared with the conventional art. In the conveying-processing device 70 exemplified in FIG. 15, particularly, an actual device may be more complicated, and more than one bridle roll are equipped. Moreover, in FIG. 15, various types of mechanical structures are included in the section simply referred to as the "processing zone". Thus, enhancing the service life of the bridle roll is greatly significant.

The present embodiment is a mere example and does not give any limitations to the present invention. Thus, the present invention may be embodied in other specific forms without departing from the essential characteristics thereof.

Figure 16:
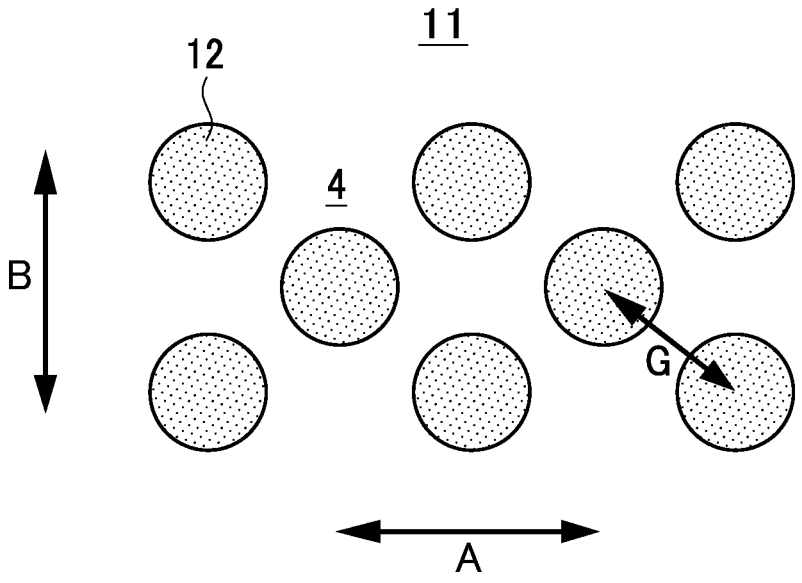
FIG. 16 is a plan view of a restraining member in the embodiment (a modified example)

For instance, the arrangement pattern of the protrusions 12 in the frictional surface 3 is not limited to that in FIG. 2 and may be a zigzag arrangement in a restraining member 11 in FIG. 16. In the arrangement pattern in FIG. 16, furthermore, an oblique direction G in the figure corresponds to the first proximity direction between the protrusions 12. However, any of the direction G, direction A, and direction B may correspond to the foregoing sliding direction. In each of those directions, the restraining member 11 may be configured to satisfy the condition of the region T and the condition of the region S in FIG. 8.

Figure 17:
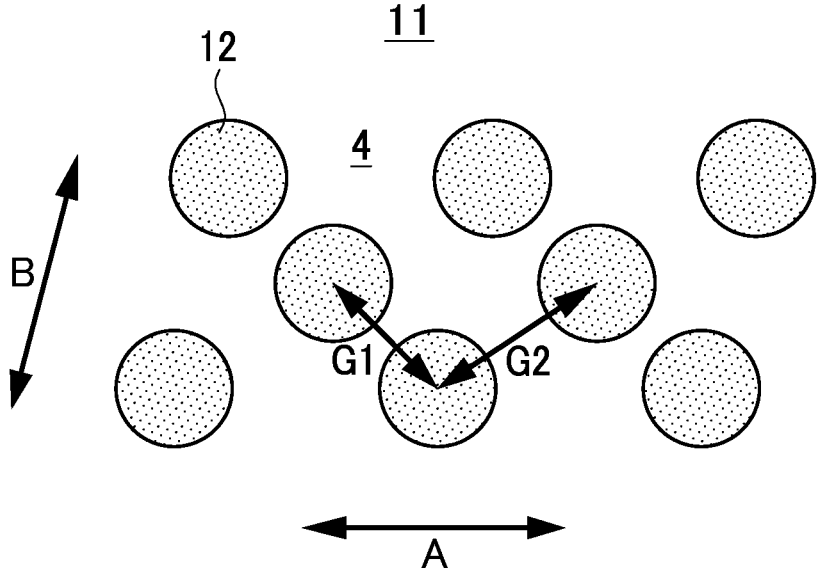
FIG. 17 is a plan view of a restraining member in the embodiment (a modified example)

When a single restraining member 10 (or 11) is used under both the conditions of the region T and the region S, as in the drawing process, it is essential only that the condition of the region T be satisfied in a direction other than the first proximity direction, selected from among the direction G, direction A, and direction B, and the condition of the region S be satisfied in another direction in which the arrangement pitch is smaller than in the selected direction. When the arrangement of the protrusions 12 is parallelogram and zigzag as shown in FIG. 17, the same setting as above may be performed in any one of the first proximity direction G1, the second proximity direction G2, the third proximity direction B, and the fourth proximity direction A. It is also possible to assume that the foregoing condition is satisfied in a direction other the the directions mentioned above.

Figure 18:
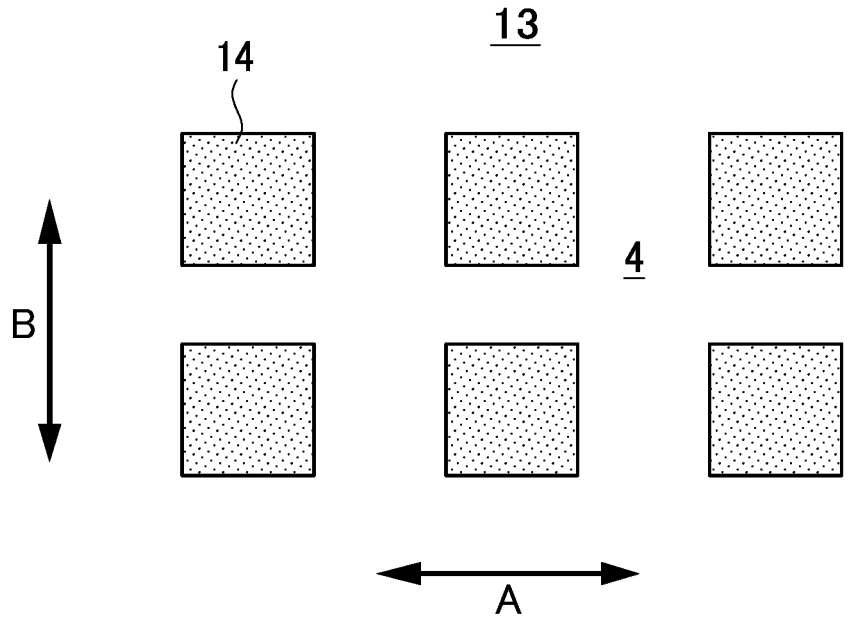
FIG. 18 is a plan view of a restraining member in the embodiment (a modified example)
Figure 19:
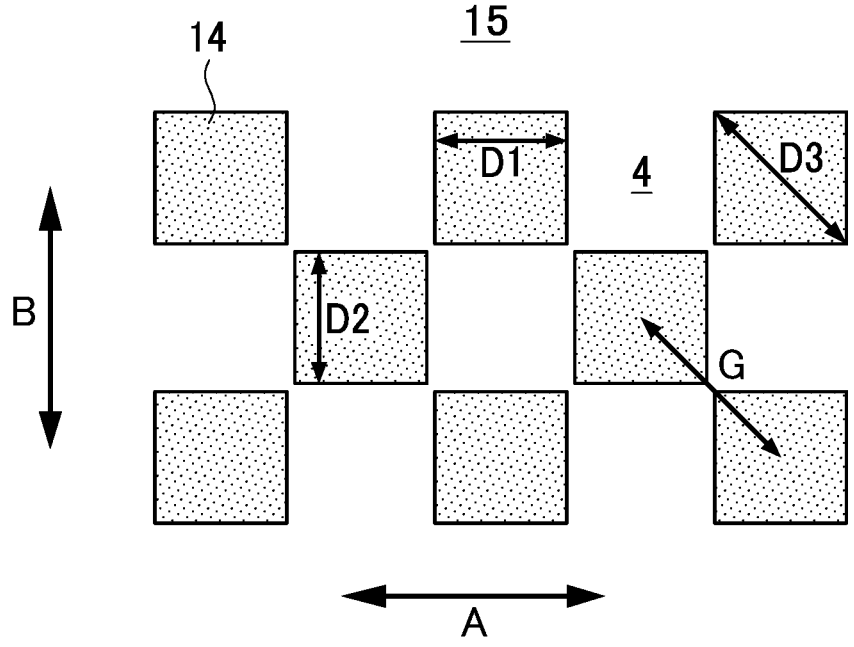
FIG. 19 is a plan view of a restraining member in the embodiment (a modified example).

Furthermore, as shown as a restraining member 13 in FIG. 18, polygonal protrusions 14, not circular, may be adopted. Of course, as shown as a restraining member 15 in FIG. 19, polygonal protrusions 14 may be arranged in a zigzag pattern. In these cases, the restraining member can be used so that any one of the direction G, direction A, and direction B corresponds to the foregoing sliding direction. The diameter D of each polygonal protrusion 14 may be assumed as a maximum of the length of a line parallel to an intended direction and across the corresponding protrusion 14. In the arrangement pattern in FIG. 19, the pattern index (P/D) may be calculated by defining the diameter D of each polygonal protrusion 14 to D1 for the sliding direction set to the direction A, to D2 for the sliding direction set to the direction B, or to D3 for the sliding direction set to the direction G.

The devices to which the restraining member 10 (hereinafter, including 11, 13 and 15) is applied are not limited to the foregoing pressing machine 50 and the conveying-processing device 70. The restraining member 10 may be applied to any devices configured to restrain an object with a restraining member and subject the object to some processing or deliver the object. In the conveying-processing device 70, for example, the "processing zone" may also be a complicated zone including a plurality of processing contents combined. Furthermore, a plurality of bridle rolls 72 may be provided in the entire conveying-processing device 70. The restraining member 10 is also applicable to a roll simply configured to only convey the conveyed sheet 74 without exerting a tensile force thereon.

REFERENCE SIGNS LIST

3 Frictional surface
4 Depression
5 Base material
10 Restraining member
11 Restraining member
12 Protrusion
13 Restraining member
14 Protrusion
15 Restraining member
50 Pressing machine
51 Die
52 Stripper
55 Workpiece plate
61 Die
62 Stripper
63 Punch
70 Conveying-processing device
72 Bridle roll
74 Conveyed sheet

The invention claimed is:

1. A restraining member comprising:
a base material configured to directly contact an object; and
a frictional surface configured to press against the object to restrain the object and exert a frictional force on the object, wherein
the frictional surface is formed as a pattern surface of the base material,
the pattern surface including protrusions separated by a depression and periodically arranged on the pattern surface,
the depression has a depth in a range of 15 to 50 μm with respect to the frictional surface, and
in a first direction of the pattern surface, the protrusions are arranged such that:
a pattern index is within a range of 1.0 to 100, the pattern index being determined by dividing an arrangement pitch of the protrusions in the first direction by a maximum diameter of the protrusions in the first direction, and
the maximum diameter of the protrusions in the first direction is within a range of 0.1 to 2 mm.

2. The restraining member according to claim 1, wherein
the pattern index in the first direction is within a range of 3.1 to 100, and
the pattern index in a second direction is within a range of 1.2 to 3.0.

3. The restraining member according to claim 1, wherein
the pattern index in the first direction is within a range of 1.8 to 100, and
the pattern index in a second direction is within a range of 1.0 to 1.7.

4. A processing device configured to perform processing on a flat workpiece by use of a punch, the processing using the punch being a punching process to punch out a portion of the workpiece to form a hole, comprising
the processing device includes the restraining member as set forth in claim 1, wherein the restraining member is configured to restrain a portion of the workpiece other than the portion to be subjected to the punching process using the punch,
and the frictional surface corresponds to a surface configured to contact the workpiece during the punching process using the punch,
the restraining member is disposed so that a radial direction centered on the portion of the workpiece to be subjected to the punching process using the punch coincides with the first direction, and
the pattern index is within a range of 1.8 to 100.

5. A processing device configured to perform processing on a flat workpiece by use of a punch, the processing using the punch being a drawing process to deform a portion of the workpiece, comprising
the processing device includes the restraining member as set forth in claim 2, wherein the restraining member is configured to restrain a portion of the workpiece other than the portion to be subjected to the drawing process using the punch, and the frictional surface is a surface configured to contact the workpiece during the drawing process using the punch, and the restraining member is disposed so that:

a radial direction centered on the portion of the workpiece using the punch coincides with the second direction; and a circumferential direction around the portion of the workpiece to be subjected to the drawing process using the punch coincides with the first direction.

6. A conveying device configured to convey a flat object by rotation of the restraining member set forth in claim 1, wherein the frictional surface is a cylindrical surface configured to contact the object during conveyance, a circumferential direction of the frictional surface coincides with the first periodic arrangement direction, and the pattern index is within a range of 1.8 to 100.

7. A processing device configured to perform processing on a flat workpiece by use of a punch, the processing using the punch being a drawing process to deform a portion of the workpiece, comprising the processing device includes the restraining member as set forth in claim 3, wherein the restraining member is configured to restrain a portion of the workpiece other than the portion to be subjected to the drawing process using the punch, and the frictional surface is a surface configured to contact the workpiece during the drawing process using the punch, and the restraining member is disposed so that:

a radial direction centered on the portion of the workpiece using the punch coincides with the second direction; and a circumferential direction around the portion of the workpiece to be subjected to the drawing process using the punch coincides with the first direction.

* * * * *